United States Patent [19]

Shukla et al.

[11] Patent Number: 4,535,576

[45] Date of Patent: Aug. 20, 1985

[54] ANTI-STATIC PROCESS FOR ABRASIVE JET MACHINING

[75] Inventors: Rahul B. Shukla; Douglas L. Shipman, both of Piscataway, N.J.

[73] Assignee: Pennwalt Corporation, Philadelphia, Pa.

[21] Appl. No.: 594,169

[22] Filed: Mar. 28, 1984

[51] Int. Cl.[3] ..... B24C 3/32

[52] U.S. Cl. ..... 51/413; 51/319

[58] Field of Search ..... 51/413, 436, 439, 410, 51/319–321, DIG. 9; 239/691; 219/69 D; 204/129.46, 224 M, 228

[56] References Cited

U.S. PATENT DOCUMENTS 2,387,193 10/1945 Swenarton ..... 51/439 X
2,669,809 2/1954 McGrath ..... 51/321 X
3,858,358 1/1975 Stachowiak et al. ..... 51/436 X
4,412,402 11/1983 Gallant ..... 51/439
4,437,614 3/1984 Garcowski ..... 239/691

FOREIGN PATENT DOCUMENTS 562994 9/1958 Canada ..... 51/DIG. 9

*Primary Examiner*—Frederick R. Schmidt
*Assistant Examiner*—Debra S. Meislin

[57] ABSTRACT

Abrasive jet machining apparatus employs a stream or mist of electrically grounded solution of a conducting electrolyte directed at or adjacent the work removal site of a workpiece to instantaneously discharge to ground all static charge build-up formed on the workpiece by the gas/abrasive powder stream as a result of the removal.

13 Claims, 3 Drawing Figures

ANTI-STATIC PROCESS FOR ABRASIVE JET MACHINING

STATEMENT OF THE INVENTION

This invention relates to abrasive jet machining apparatus, and more particularly to such apparatus where static electric charges on the workpiece are maintained substantially at zero voltages.

BACKGROUND AND SUMMARY OF THE INVENTION

Abrasive jet machining may be defined as the removal of material through the reaction of a focused, high velocity stream of fine grit or powder-loaded air. Basic apparatus for carrying out the abrasive jet machining process may include an air or gas supply, a pressurized powder reservoir with cooperating vibrating means (or a non-pressurized powder reservoir using venturi principles), a mixing chamber, and a conduit for feeding the resultant powder to a hand held piece having an appropriate nozzle for directing the powder-air mixture against a workpiece for delicate removal of portions thereof. A foot or remote switch may control the air pressure at the nozzle. The pulsation of the vibrating means or the positive pressure within the powder reservoir urges the powder through a narrow orifice or passageway to contact a pressurized air stream or jet. The amount of powder delivered is dependent upon the amplitude of vibration, pressure of the delivery system, diameters of the handpiece nozzle and power feed supply orifice or passageway, and size of powder, among other factors.

The abrasive powder, such as aluminum oxide and silicon carbide, for example, should be well classified and clean, and typically ranges in size from about 10 to 150 microns in diameter.

Abrasive jet machining is not a mass material removal process, but one of finishing or precision cutting. Because of the small amount of abrasive powder flowing through the handpiece nozzle at any given instant, it is not difficult to remove selected portions of the workpiece, such, for example, as the removal of conformal coatings from printed circuit boards. During removal of the coatings, static electric charges of several thousand volts readily build up on the workpiece in a matter of only several seconds. Several prior art devices have been developed which attempt to reduce or eliminate these undesirable charges by introducing a mist or jet of water at or adjacent the work site. These devices have indeed reduced charge build-up to levels as low as 500–700 volts, which voltages however, are still sufficiently high to produce discharges which often damage the delicate circuitry of modern printed circuit boards.

The present invention provides abrasive jet machining apparatus which produces no measurable static electric build-up on the workpiece, and hence, is suitable for use with the most delicate of printed circuits.

Briefly, the present apparatus employs a conducting solution of an electrolyte, typically NaCl, although not limited thereto, as the liquid or mist medium. The solution however, unlike prior art devices, must be electrically grounded in order to instantaneously conduct any charge build-up on the workpiece away therefrom to ground. The solution may be contained in a grounded metallic container or receptacle, or the receptacle may comprise a non-conducting material such as plastic, for example, having a grounded metallic article immersed within the solution. Alternatively, a wholly ungrounded plastic solution container may be used if the solution within the tubing leading to the handpiece is suitably grounded, or the metallic nozzle itself, if such a nozzle is employed through which the solution must pass, is grounded. We have found that static build-up on the workpiece may even be prevented by interposing a grounded wire in the path of the jet stream of solution or mist between the solution nozzle and workpiece.

DETAILED DESCRIPTION OF THE INVENTION

Figure 1:
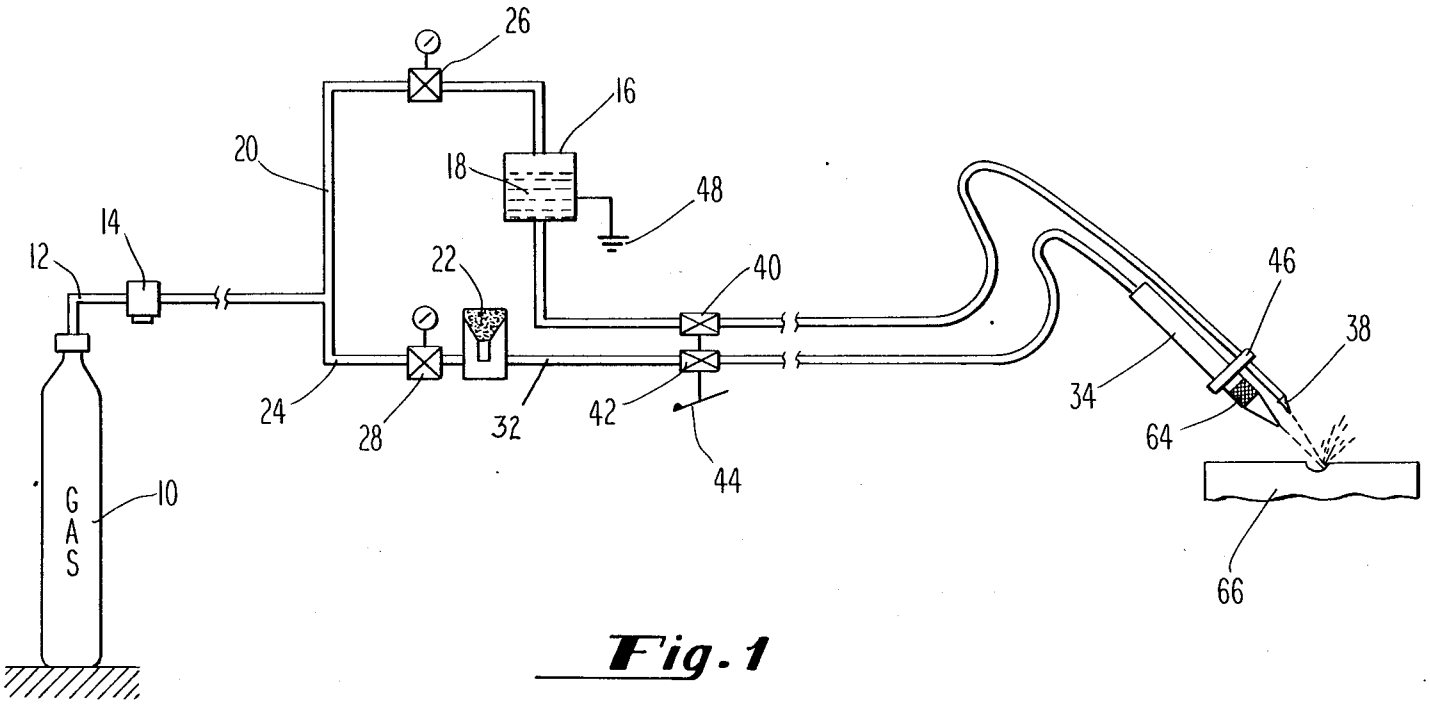
FIG. 1 is a schematic representation of the anti-static abrasive jet machining apparatus of the present invention.

Pressurized air or gas 10 is fed by high pressure tubing 12 into a conventional filter 14. The filtered air or gas is directed into an air-tight receptacle 16 containing a conducting electrolyte solution 18 therein by means of tubing or line 20, and also into an abrasive powder supply and powder metering device 22 through tubing or line 24. Pressure applied to receptacle 16 and metering device 22 may be independently controlled by pressure regulators 26 and 28 respectively. Thus, an air/abrasive powder mixture flows in tubing or line 32 to handpiece 34 while solution 18 is caused to flow in line 36 to solution nozzle 38. Optionally, solution 18 may be pumped from receptacle 16 by a centrifrugal pump, a reciprocal pump, or other suitable type pump. Cut-off or pinch valves 40 and 42 in lines 36 and 32 respectively are simultaneously actuated by a conventional foot control pedal 44. Solution nozzle 38 is adjustably mounted to handpiece 34 by clamping means 46.

Figure 2:
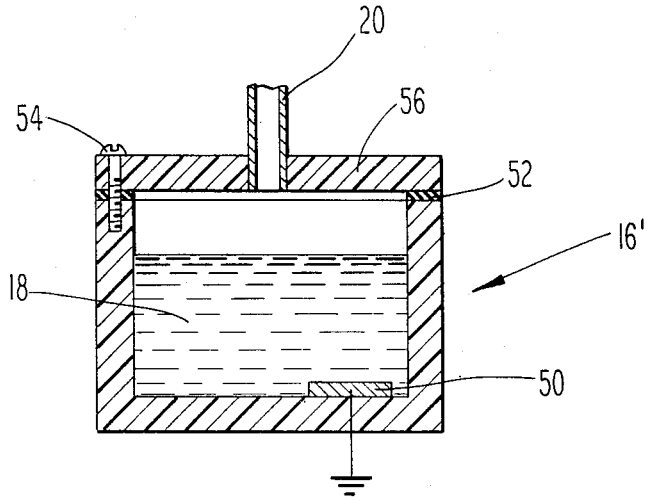
FIG. 2 is a sectional view of the receptacle of FIG. 1, but modified in accordance with one aspect of the present invention.

Receptacle 16 may be metallic or non-metallic, i.e., electrically conducting or non-conducting. If metallic, receptacle 16 is connected to ground 48. If non-metallic (FIG. 2), a metallic bar, rod, or article 50 may be immersed within non-metallic receptacle 16' and the article suitably grounded. Receptacles 16 and 16' must be capable of withstanding high internal pressures. Thus, receptacle 16' for example, may include gasket 52 and a plurality of screw means 54 for securing cover member 56 to the body portion of receptacle 16'. Receptacle 16 may similarly or conventionally be rendered air-tight.

Abrasive powder metering or mixing devices are known and typically comprise an abrasive powder container from which the powder is metered with aspirated or passing air to form an air powder mixture, the proportions of each being controlled by known means. An especially suitable metering device is shown and described in a copending application of D. L. Shipman, coinventor herein, for "Pneumatic Powder Metering Apparatus with Improved Throttling Mechanism", U.S. Ser. No. 548,270, filed Nov. 3, 1983.

Figure 3:
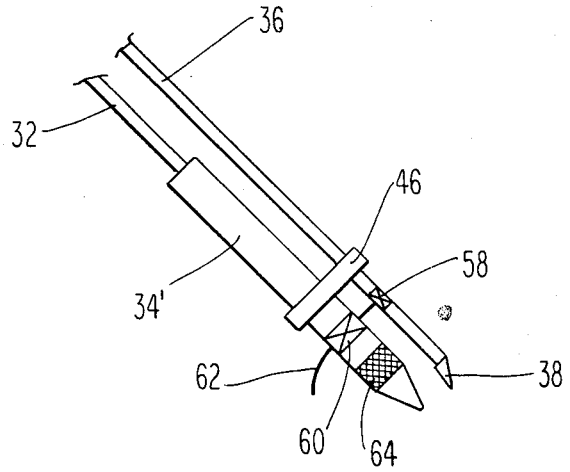
FIG. 3 is a diagrammatic view of a modified handpiece assembly.

In lieu of foot control pedal 44, pinch valves 58 and 60, or other suitable type valves, may be provided in solution line 36 and handpiece 34' (FIG. 3) respectively, both valves being simultaneously controlled by trigger 62. Adjustment of handpiece nozzle may be effected by rotating adjusting barrel 64. Optionally, solution nozzle 38 may be controlled (not shown) to eject a mist. Specific valve mechanisms and means for their simultaneous actuation by foot pedal 44 or trigger 62 are known and form no part of the present invention.

Solution 18 is preferably a 0.2% solution, by weight, of NaCl. Concentrations lower than about 0.2% were found not to be sufficiently conductive. Concentrations approaching saturation resulted in caking of NaCl in the nozzles. Concentrations ranging between about 0.2 and 0.5% worked very satisfactorily in continuously discharging to ground any static electricity build-up formed during removal of coatings from printed circuit boards, for example.

In operation, solution 18 is introduced into receptacle 16 or 16' and the receptacle made pressure tight. Sufficient abrasive powder of the desired type and particle size is placed in the powder metering device 22. Gas 10 is then caused to flow into tubing 12 and pressure regulators 26 and 28 adjusted.

Workpiece 66 may be exposed to the atmosphere, or placed under a hood with exhaust, or positioned within an abrasive work chamber such that the handpiece may be manipulated therein through hand holes provided in the work chamber. The solution nozzle may eject a jet stream of solution 18 or a mist thereof, the latter being substantially equivalent to a jet stream by permitting static charges to be instantaneously discharged to ground through the mist droplets.

The jet stream of solution, or mist, may be directed at the exact target point of the air/abrasive stream, or it may intersect the air/abrasive stream. The anti-static effectiveness of our inventive apparatus exists even though the stream or mist is slightly off the target site since the deflected spray or mist instantaneously conducts away the harmful static charges. In a way, the mist may be likened to a grounding brush having countless metallic bristles to thereby provide and insure good electrical contact to points adjacent the point of powder impact on the workpiece.

We claim:

1. Abrasive jet machining apparatus for removing portions of a workpiece comprising, a gas supply and means for containing said gas supply, an abrasive powder supply communicating with said gas supply, and means for containing said abrasive powder supply, means for providing a powder stream from said gas and abrasive powder, an electrically conducting electrolyte solution, connected to a ground, communicating with said gas supply, and means for containing said electrolyte solution, means for simultaneously delivering said powder stream and solution to said workpiece portions whereby build-up of static charges on said workpiece are instantaneously discharged to said ground through said electrolyte solution connected to said ground.

2. Apparatus of claim 1 wherein said electrolyte solution is preferably an electrically conducting solution of sodium chloride.

3. Apparatus of claim 2 wherein concentration of said sodium chloride solution ranges between about 0.2 to 1.0%.

4. Apparatus of claim 1 wherein said electrolyte solution is contained within a metallic receptacle connected to said ground.

5. Apparatus of claim 1 wherein said electrolyte solution is contained within a non-metallic receptacle, a metallic article immersed in said contained solution, said metallic article connected to said ground.

6. Apparatus of claim 1 wherein said solution is delivered to said workpiece portions as a jet stream.

7. Apparatus of claim 1 wherein said solution is delivered to said workpiece portions as a mist.

8. Apparatus of claim 6 wherein said solution jet stream strikes said workpiece portions at an identical point where said powder stream impacts said workpiece portions.

9. Apparatus of claim 6 wherein said solution jet stream intersects said powder stream.

10. Apparatus of claim 6 wherein said solution jet stream strikes said workpiece portions adjacent point where said powder stream impacts said workpiece portions.

11. Apparatus of claim 7 wherein said mist strikes said workpiece portions at an identical point where said powder stream impacts said workpiece portions.

12. Apparatus of claim 7 wherein said mist intersects said powder stream.

13. Apparatus of claim 7 wherein said mist strikes said workpiece portions adjacent point where said powder stream impacts said workpiece portions.

* * * * *